US009097104B2

(12) United States Patent
Royer et al.

(10) Patent No.: US 9,097,104 B2
(45) Date of Patent: Aug. 4, 2015

(54) EROSION RESISTANT FLOW NOZZLE FOR DOWNHOLE TOOL

(75) Inventors: Rodney S. Royer, Spring, TX (US); Henry Joe Jordan, Jr., Willis, TX (US); Jeffrey E. Kubiak, Houston, TX (US); Christopher Hall, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 821 days.

(21) Appl. No.: 13/292,965

(22) Filed: Nov. 9, 2011

(65) Prior Publication Data

US 2013/0112399 A1 May 9, 2013

(51) Int. Cl.

| | |
|---|---|
| ***E21B 43/29*** | (2006.01) |
| ***E21B 43/08*** | (2006.01) |
| ***E21B 41/00*** | (2006.01) |

(52) U.S. Cl.
CPC ..... *E21B 43/08* (2013.01); *E21B 41/0078* (2013.01); *E21B 43/29* (2013.01)

(58) Field of Classification Search
CPC ..... E21B 41/0078; E21B 37/00; E21B 43/29
USPC ..... 166/222
See application file for complete search history.

(56) References Cited

U.S. PATENT DOCUMENTS

| | | | |
|---|---|---|---|
| 2,800,912 | A | 7/1957 | McCamish et al. |
| 3,145,776 | A | 8/1964 | Pittman |
| 3,198,256 | A | 8/1965 | Kirby, II |
| 3,823,789 | A | 7/1974 | Garner |
| 4,037,661 | A | 7/1977 | Ford |
| 4,126,193 | A | 11/1978 | Brown et al. |
| 4,189,243 | A | 2/1980 | Black |
| 4,476,020 | A | 10/1984 | Cheetham |
| 4,498,543 | A | 2/1985 | Pye et al. |
| 4,782,896 | A | 11/1988 | Witten |
| 4,826,217 | A | 5/1989 | Guerrero |
| 5,577,559 | A | 11/1996 | Voll et al. |

(Continued)

FOREIGN PATENT DOCUMENTS

| | | |
|---|---|---|
| CA | 2608050 A1 | 4/2008 |
| EP | 0935050 A2 | 8/1999 |

(Continued)

OTHER PUBLICATIONS

Office Action received in corresponding Canadian Application No. 2,794,302 dated Jan. 24, 2014.

(Continued)

*Primary Examiner* — Giovanna C Wright
(74) *Attorney, Agent, or Firm* — Blank Rome LLP

(57) ABSTRACT

An erosion resistant nozzle is brazed to the surface of a tubular, such as a shunt tube of a wellscreen apparatus, for use in a wellbore. The nozzle is elongated and defines an aperture for communicating exiting flow from the tubular's port. The lead end of the nozzle disposed downstream of the exiting flow can be lengthened to prevent erosion to the tubular. The lead endwall of the nozzle's aperture can be angled relative to the nozzle's length and can be rounded. The nozzle can be composed of an erosion resistant material or can be composed of a conventional material having an erosion resistant coating or plating thereon. Being elongated with a low height, the nozzle can have a low profile on the tubular, and the aperture's elongating can be increased or decreased to increase or decrease the flow area through the nozzle.

33 Claims, 10 Drawing Sheets

(56) References Cited

U.S. PATENT DOCUMENTS

| | | | | |
|---|---|---|---|---|
| 5,597,040 | A | 1/1997 | Stout et al. | |
| 5,636,691 | A | 6/1997 | Hendrickson et al. | |
| 5,661,767 | A | 8/1997 | Roux | |
| 5,823,273 | A | 10/1998 | Ravi et al. | |
| 5,829,539 | A | 11/1998 | Newton et al. | |
| 5,842,516 | A | 12/1998 | Jones | |
| 5,918,911 | A | 7/1999 | Sims | |
| 6,006,838 | A * | 12/1999 | Whiteley et al. | 166/306 |
| 6,138,777 | A | 10/2000 | Fraim et al. | |
| 6,227,303 | B1 | 5/2001 | Jones | |
| 6,491,097 | B1 | 12/2002 | Oneal et al. | |
| 6,557,634 | B2 | 5/2003 | Hailey, Jr. et al. | |
| 6,749,023 | B2 | 6/2004 | Nguyen et al. | |
| 6,973,974 | B2 | 12/2005 | McLoughlin et al. | |
| 7,096,946 | B2 | 8/2006 | Jasser et al. | |
| 7,373,989 | B2 | 5/2008 | Setterberg, Jr. | |
| 7,419,002 | B2 | 9/2008 | Dybevik et al. | |
| 7,497,267 | B2 | 3/2009 | Setterberg, Jr. et al. | |
| 7,503,384 | B2 | 3/2009 | Coronado | |
| 7,559,357 | B2 | 7/2009 | Clem | |
| 7,597,141 | B2 | 10/2009 | Rouse et al. | |
| 7,841,396 | B2 | 11/2010 | Surjaatmadja | |
| 7,886,819 | B2 | 2/2011 | Setterberg, Jr. et al. | |
| 7,913,763 | B2 | 3/2011 | D'Amico | |
| 2002/0108752 | A1 | 8/2002 | Morey et al. | |
| 2002/0125006 | A1 | 9/2002 | Hailey, Jr. et al. | |
| 2004/0140089 | A1 | 7/2004 | Gunneroed | |
| 2005/0028977 | A1 | 2/2005 | Ward | |
| 2005/0061501 | A1 | 3/2005 | Ward et al. | |
| 2005/0082060 | A1 | 4/2005 | Ward et al. | |
| 2005/0236153 | A1 | 10/2005 | Fouras et al. | |
| 2005/0284643 | A1 | 12/2005 | Setterberg, Jr. | |
| 2006/0022073 | A1 | 2/2006 | King et al. | |
| 2006/0151174 | A1 | 7/2006 | Cantin et al. | |
| 2006/0237197 | A1 | 10/2006 | Dale et al. | |
| 2008/0314588 | A1 | 12/2008 | Langlais et al. | |
| 2009/0255667 | A1 | 10/2009 | Clem et al. | |
| 2011/0266374 | A1 | 11/2011 | Hammer | |

FOREIGN PATENT DOCUMENTS

| | | | |
|---|---|---|---|
| EP | 1609946 | A2 | 12/2005 |
| GB | 640310 | | 7/1950 |
| GB | 2178342 | A | 2/1987 |
| GB | 2426989 | A | 12/2006 |
| WO | 2004/018837 | A1 | 3/2004 |
| WO | 2011/137074 | A1 | 3/2011 |

OTHER PUBLICATIONS

First Examination Report in counterpart Australian Appl. 2012241190, dated Jan. 28, 2014.

Pedroso, CA, et al., "Lighweight Proppants: Solution for Gravel Packing Horizontal Wells Under Extreme Conditions", SPE 98298; Feb. 2006; 1-12.

Porter, DA, et al., "Designing and Completing High-Rate Oil Producers in a Deepwater Unconsolidated Sand", SPE 58735; Feb. 2000; 1-19.

Ross, Colby M., "New Tool Designs for High Rate Gravel Pack Operations", SPE 29276; Mar. 1995; 227-234.

Hill, Leo E, "Completion Tools Proven Successful in Deepwater Frac Packs and Horizontal Gravel Packing", IADC/SPE 74492; Feb. 2002, 1-15.

Mendez, A, et al., "A Quantum Leap in Horizontal Gravel Pack Technology", SPE 94945; Jun. 2005; 1-7.

Burton, R.C., et al., Innovative Completion Design and Well Performance Evaluation for Effective Frac-Packing of Long Intervals: A Case Study from the West Natuna Sea, Indonesia, SPE 74351; Feb. 2002; 1-24.

EP Search report in counterpart EP App;. 12191982.3, dated Mar. 14, 2014.

Welltonic, "Abrasive Jetting Sub," Brochure, available from http://www.welltonic.co.uk, obtained on undated.

Weatherford, "Conventional Well Screens," Brochure, copyright 2004-2010.

* cited by examiner

EROSION RESISTANT FLOW NOZZLE FOR DOWNHOLE TOOL

BACKGROUND

A wellscreen may be used on a production string in a hydrocarbon well and especially in a horizontal section of the wellbore. Typically, the wellscreen has a perforated base pipe surrounded by a screen that blocks the flow of particulates into the production string. Even though the screen may filter out particulates, some contaminants and other unwanted materials can still enter the production string.

To reduce the inflow of unwanted contaminants, operators can perform gravel packing around the wellscreen. In this procedure, gravel (e.g., sand) is placed in the annulus between wellscreen and the wellbore by pumping a slurry of liquid and gravel down a workstring and redirecting the slurry to the annulus with a crossover tool. As the gravel fills the annulus, it becomes tightly packed and acts as an additional filtering layer around the wellscreen to prevent the wellbore from collapsing and to prevent contaminants from entering the production string.

Ideally, the gravel uniformly packs around the entire length of the wellscreen, completely filling the annulus. However, during gravel packing, the slurry may become more viscous as fluid is lost into the surrounding formation and/or into the wellscreen. Sand bridges can form where the fluid loss occurs, and the sand bridges can interrupt the flow of the slurry and prevent the annulus from completely filling with gravel.

As shown in FIG. 1, for example, a wellscreen 30 is positioned in a wellbore 14 adjacent a hydrocarbon bearing formation. Gravel 13 pumped in a slurry down the production tubing 11 passes through a crossover tool 33 and fills an annulus 16 around the wellscreen 30. As the slurry flows, the formation may have an area of highly permeable material 15, which draws liquid from the slurry. In addition, fluid can pass through the wellscreen 30 into the interior of the tubular and then back up to the surface. As the slurry loses fluid at the permeable area 15 and/or the wellscreen 30, the remaining gravel may form a sand bridge 20 that can prevent further filling of the annulus 16 with gravel.

To overcome sand-bridging problems, shunt tubes have been developed to create an alternative route for gravel around areas where sand bridges may form. For example, a gravel pack apparatus 100 shown in FIGS. 2A-2B positions within a wellbore 14 and has shunt tubes 145 for creating the alternate route for slurry during the gravel pack operation. As before, the apparatus 100 can connect at its upper end to a crossover tool (33; FIG. 1), which is in turn suspended from the surface on a tubing or work string (not shown).

The apparatus 100 includes a wellscreen assembly 105 having a base pipe 110 with perforations 120 as described previously. Wound around the base pipe 110 is a wire screen 125 that allows fluid to flow therethrough while blocking particulates. The wellscreen assembly 105 can alternatively use any structure commonly used by the industry in gravel pack operations (e.g. mesh screens, packed screens, slotted or perforated liners or pipes, screened pipes, prepacked screens and/or liners, or combinations thereof).

The shunt tubes 145 are disposed on the outside of the base pipe 110 and can be secured by rings (not shown). As shown in FIG. 2A, centralizers 130 can be disposed on the outside of the base pipe 110, and a tubular shroud 135 having perforations 140 can protect the shunt tubes 145 and wellscreen 105 from damage during insertion of the apparatus 100 into the wellbore 14.

At an upper end (not shown) of the apparatus 100, each shunt tube 145 can be open to the annulus 16. Internally, each shunt 145 has a flowbore for passage of slurry, and nozzles 150 dispose at ports 147 in the sidewall of each shunt tube 145 and allow the slurry to exit the tube 145. As shown in FIG. 2C, the nozzles 150 can be placed along the shunt tube 145 so each nozzle 150 can communicate slurry from the ports 147 and into the surrounding annulus 16. As shown, the nozzles 150 are typically oriented to face an end of the wellbore's downhole end (i.e., distal from the surface) to facilitate streamlined flow of the slurry therethrough.

In operation, the apparatus 100 is lowered into the wellbore 14 on a workstring and is positioned adjacent a formation. A packer (18; FIG. 1) is set, and gravel slurry is then pumped down the workstring and out the outlet ports in the crossover tool (33; FIG. 1) to fill the annulus 16 between the wellscreen 105 and the wellbore 14. Since the shunt tubes 145 are open at their upper ends, the slurry can flow into both the shunt tubes 145 and the annulus 16, but the slurry typically stays in the annulus as the path of least resistance until a bridge is formed. As the slurry loses liquid to a high permeability portion 15 of the formation and the wellscreen 30, the gravel carried by the slurry is deposited and collects in the annulus 16 to form the gravel pack.

Should a sand bridge 20 form and prevent further filling below the bridge 20, the gravel slurry continues flowing through the shunt tubes 145, bypassing the sand bridge 20 and exiting the various nozzles 150 to finish filling annulus 16. The flow of slurry through one of the shunt tubes 145 is represented by arrow 102.

Due to pressure levels and existence of abrasive matter, the flow of slurry in the shunt tubes 145 tends to erode the nozzles 150, reducing their effectiveness and potentially damaging the tool. To reduce erosion, the nozzles 150 typically have flow inserts that use tungsten carbide or a similar erosion resistant material. The resistant insert fits inside a metallic housing, and the housing welds to the exterior of the shunt tube 145, trapping the carbide insert.

For example, FIG. 3A shows a cross-sectional view of a prior art nozzle 150 disposed on a shunt tube 145, and FIG. 3B shows a perspective and a cross-sectional view of the prior art nozzle 150. For slurry to exit the shunt tube 145, a port 147 is drilled in the side of the tube 145 typically with an angled aspect in approximate alignment with a slurry flow path 102 to facilitate streamlined flow. Like the port 147, the nozzle 150 also has an angled aspect, pointing downhole and outward away from the shunt tube 145.

A tubular carbide insert 160 of the nozzle 150 is held in alignment with the drilled port 147, and an outer jacket 165 of the nozzle 150 is attached to the shunt tube 145 with a weld 170, trapping the carbide insert 160 against the shunt tube 145 and in alignment with the drilled hole 147. The outer jacket 165 also serves to protect the carbide insert 160 from high weld temperatures, which could damage or crack the insert 160. With the insert 160 disposed in the outer jacket 165 in this manner, sand slurry exiting the tube 145 through the nozzle 150 is routed through the carbide insert 160, which is resistant to damage from the highly abrasive slurry.

The nozzle 150 and the manner of constructing it on the shunt tube 145 suffer from some drawbacks. During welding of the nozzle 150 to the shunt tube 145, the nozzle 150 can shift out of exact alignment with the drilled hole 147 in the tube 145 so that exact alignment between the nozzle 150 and the drilled hole 147 after welding is not assured. To deal with this, a piece of rod (not shown) may need to be inserted through the nozzle 150 and into the drilled hole 147 to maintain alignment during the welding. However, holding the nozzle 150 in correct alignment while welding it to the shunt tube 145 is cumbersome and requires time and a certain level of skill and experience.

In another drawback, the carbide insert 160 actually sits on the surface of the tube 145, and the hole 147 in the tube's wall is part of the exit flow path 102. Consequently, abrasive slurry passing through the hole 147 may cut through the relatively soft tube material and bypass the carbide insert 160 entirely, causing the shunt tube 145 to fail prematurely.

To address some of the drawbacks, other nozzles configurations have been disclosed in U.S. Pat. Nos. 7,373,989 and 7,597,141, which are incorporated herein by reference. U.S. Pat. Pub. No. 2008/0314588 also discloses other nozzles for shunt tubes.

Although existing nozzles may be useful and effective, the arrangements still complicate manufacture of downhole tools, alter the effective area available in the tool for design and operation, and have features prone to potential failure. Accordingly, the subject matter of the present disclosure is directed to overcoming, or at least reducing the effects of, one or more of the problems set forth above.

SUMMARY

An erosion resistant nozzle is brazed directly to the surface of a tubular, such as a shunt tube of a wellscreen apparatus for use in a wellbore. The nozzle is elongated and defines an aperture for communicating exiting flow from the tubular's port. The lead end of the nozzle exposed downstream of the exiting flow can encompass most of the length of the nozzle to prevent erosion to the tubular from backwash, and the lead endwall of the nozzle's aperture can be angled relative to the nozzle's length and can be rounded to better align with the flow of slurry from the tubular. The nozzle can be composed of an erosion resistant material or can be composed of a conventional material having an erosion resistant coating or plating thereon. Being elongated with a low height, the nozzle can have a low profile on the tubular, and the aperture's elongation can be increased or decreased to increase or decrease the flow area through the nozzle.

The foregoing summary is not intended to summarize each potential embodiment or every aspect of the present disclosure.

BRIEF DESCRIPTION OF THE DRAWINGS

FIG. 7C-1 is a cross-sectional view of the nozzle having deflectors disposed at the lead and tail ends.

FIG. 7C-2 is a perspective view of the nozzle having alternative deflectors disposed at the lead and tail ends.

FIGS. 7D-1 through 7D-4 show alternative nozzles having a body that forms at least a portion of a flow tube.

FIGS. 11A-1 and 11A-2 are cross-sectional and perspective views of a nozzle having hard treated surface applied to the inner aperture.

DETAILED DESCRIPTION

Figure 4A:
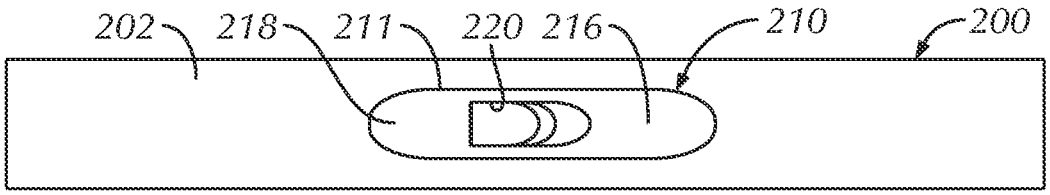
FIGS. 4A-4C are top, side cross-sectional, and end views of a shunt tube having a nozzle according to the present disclosure.
Figure 4B:
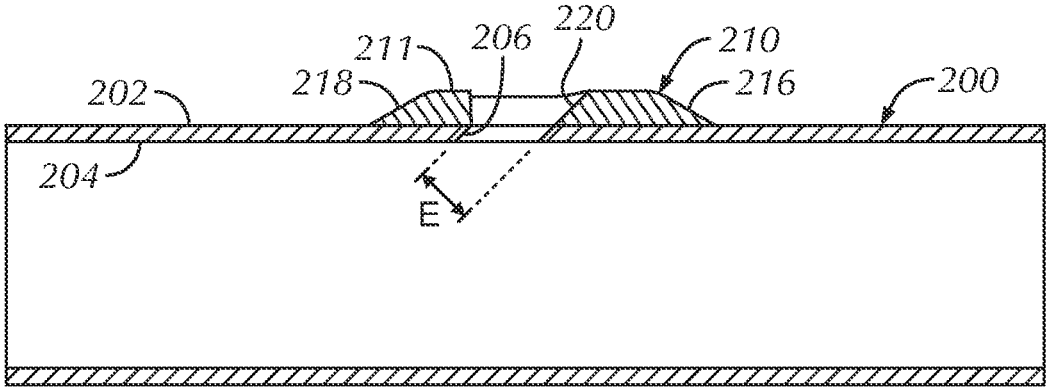
Figure 4C:
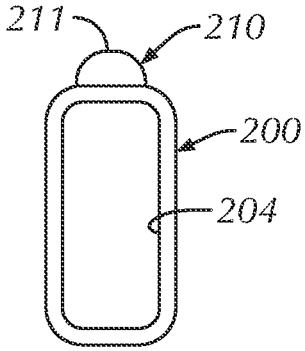

FIGS. 4A-4C show top, cross-sectional, and end views of a flow tube or other conduit 200 having a nozzle 210 according to the present disclosure. Only portion of the tube 200 is shown, and the tube 200 may be longer than shown and may have more than one nozzle 210. In one implementation, the flow tube 200 can be a shunt tube used on a wellscreen assembly as described previously so current reference is made to a shunt tube, but other implementations and assemblies may use a comparable flow tube or conduit 200 having a nozzle 210.

The shunt tube 200 can have a rectangular cross-section with a port 206 defined in one of the sidewalls 202 for the passage of slurry (fluid and sand) out of the tube's inner passage 204 and into a surrounding annulus of the wellscreen (not shown). Rather than using a typical nozzle having a housing welded to the shunt tube 200 to hold a carbide insert as in the prior art, the nozzle 210 of the present disclosure includes a single body 211 affixed directly to the sidewall 202 of the shunt tube 200 at the port 206.

Referring concurrently to FIGS. 5A-5D showing perspective, top, cross-sectional, and bottom views of the nozzle 210, the nozzle's body 211 is generally elongated with its length $L_1$ being greater than its width $W_1$. The nozzle's body 211 is also generally flat with its height H being less than its width $W_1$. When the nozzle's body 211 is disposed on the flow tube 200, the nozzle's height H extends a distance beyond the exterior surface of the flow tube 220. Preferably, this distance has a low profile on the surface of the tube 220 so that the nozzle's height H preferably gives the nozzle's body 211 a slim profile.

The nozzle's body 211 has a top surface 212 and a bottom surface 214 and defines an aperture 220 therethrough. A lead end 216 of the body 211 is disposed on one side of the aperture 220, while a tail end 218 is disposed on the other side. The top surface 212 is curved about the width of the body 211, and the tail and lead ends 216 and 218 each define a taper. The contours of the top surface 212 and these ends 216 and 218 create a smooth profile to the nozzle 210 and removes any pinch or hang points that could catch during run-in or pull-out of the shunt tube 200.

As shown in FIGS. 4A-4C, the nozzle's bottom surface 214 affixes to the exterior surface of the shunt tube 200 so that a bottom end of the aperture 220 communicates with the port 206. The body's top surface 212 exposes a top end of the aperture 220, which like the body 211 is elongated with its length being greater than its width. When affixed to the tube 200, the body's tail end 218 is exposed on one side of the aperture 220 upstream of exiting flow from the port 206, while the body's lead end 216 is exposed on an opposing side of the aperture 220 downstream of exiting flow from the port 206.

As noted herein, the flow of slurry or any other fluid exiting the port 206 can cause erosion, but the nozzle 210 resists the erosion to protect the port 206 and shunt tube 200. To do this, the body 211 is resistant to erosion and can be composed of an erosion-resistant material, such as a tungsten carbide, a ceramic, or the like. Alternatively, the nozzle's body 211 can be composed of a material with an erosion-resistant coating or electroplating. For example, the erosion resistant body 211 can be composed of a standard material, such as 316 stainless steel, and can have an erosion-resistant coating of hard chrome or electroplating of silicon carbide disposed thereon.

During gravel packing, frac packing, or the like, backwash of exiting flow from a conventional nozzle's aperture can tend to cause more erosion downstream of the port 206. The disclosed nozzle 210 preferably addresses this tendency for backwash erosion. When slurry flows out the shunt's port 206, for example, the slurry passes through the aperture 220 in the nozzle's body 210. The tail end 218 is upstream of the exiting slurry and tends to experience less of the flow, while the lead end 216 experiences more of the flow, and especially backwash of flow redirected back toward the shunt tube 200 after exiting the nozzle's aperture 220. This backwash can be caused by the redirection of exiting flow when engaging the borehole, protective screen, or the like. Therefore, the lead end 218 is preferably more reinforced as it is more likely to receive the backwash.

For example, the lead end 216 can encompass more of the body 211 than the tail end 218. In other words, the body's lead end 216 can define a longer extent along the length $L_1$ of the body 211 than the tail end 218 (i.e., $L_4$ is greater than $L_5$), or the portion of the top surface on the lead end 216 can encompass more of the surface area of the body 211 than the tail end 218. Depending on the characteristics of the implementation, the lead end 216 can be increased or shortened in length than currently depicted. Additionally, the ends 216 and 218 could be the same as long as the lead end 216 is sufficiently long or dense enough to inhibit erosion to the tube 200.

Figure 5A:
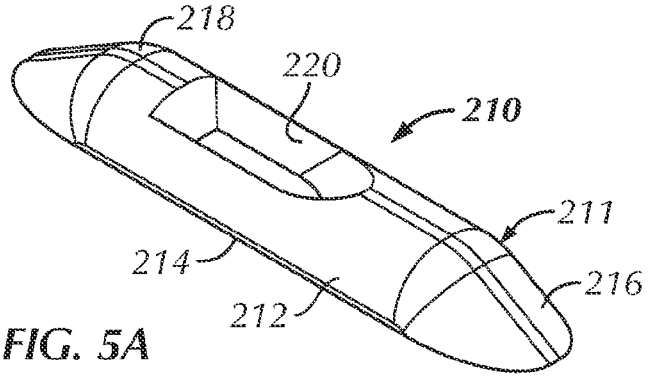
FIGS. 5A-5D are perspective, top, side cross-sectional, and bottom views of the nozzle.
Figure 5B:
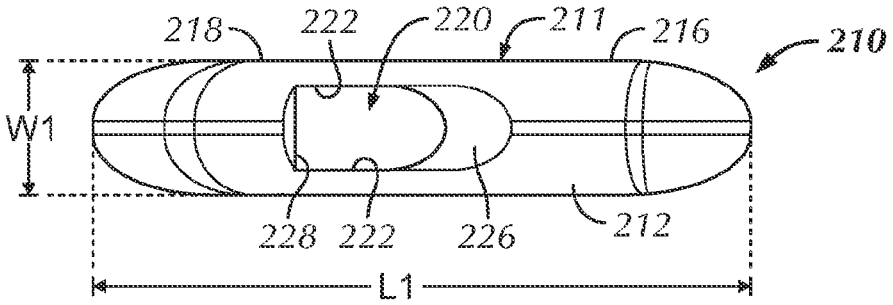
Figure 5C:
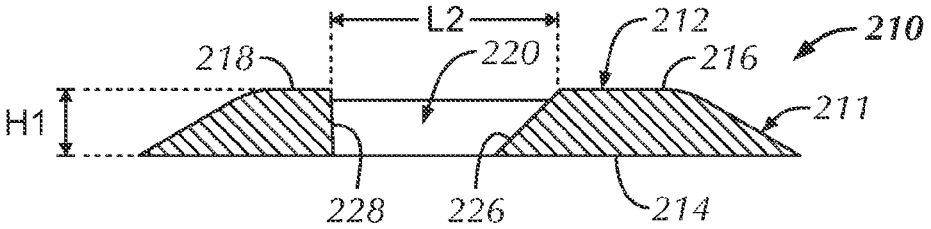

As best shown in FIG. 5C, the aperture 220 has a lead endwall 226 defining a first angle relative to the length of the body 210 (which runs parallel to the axis of the shunt tube 200). The lead endwall 226 is also rounded to define a radius that helps resist erosion. In general, the angle of the lead endwall 226 to redirect the flow out of the tubular's port (206) to the surrounding annulus can be about 45-degrees with respect to the tube's axis. Of course, the angle may vary depending on the particular erosion characteristics associated with the type of fluid, slurry, materials, flow velocity, etc. Changes in the angle may necessitate changes in the overall height H of the nozzle's body 211. In any event, the overall height H of the nozzle 210 is less than conventionally achieved in the art.

Figure 7A:
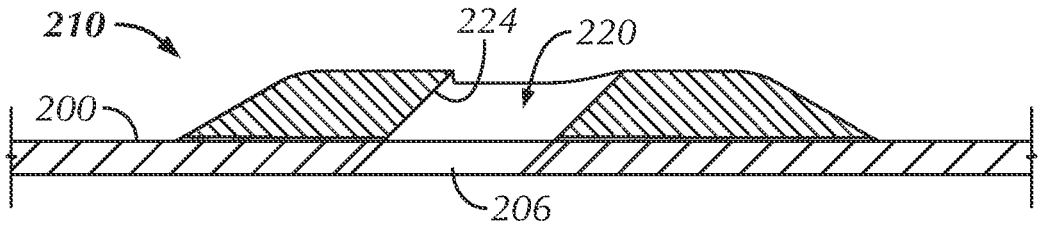
FIG. 7A is a cross-sectional view of an alternative nozzle having a different tail endwall for the aperture.

A tail endwall 228 of the aperture can define a second angle, which can be the same as or greater than the first angle of the lead endwall 226. Having a square shoulder as shown (even slightly angled backwards) can facilitate manufacture of the nozzle 210. (As shown alternatively in FIG. 7A, though, a tail endwall 224 can have the same angle as the lead endwall 226 and may also define a radius.) As best shown in FIG. 5B, the aperture 220 also has sidewalls 222 extending from the tail endwall 228 to the lead endwall 226, and these sidewalls 222 can be perpendicular to the bottom surface 214 as shown, but they could also taper outward from the bottom surface 214 to the top surface 212.

Figure 5D:
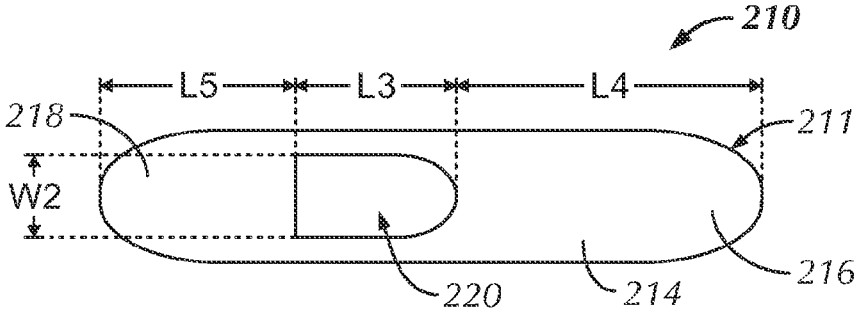

As shown in FIG. 5D, the bottom end of the aperture 220 has a contour matching the tube's port 206, which is elongated with a rounded lead end. As shown in FIG. 5B, the aperture 220 in the nozzle 210 is elongated along the body 211, and the top end of the aperture 220 defines a greater area than the bottom end of the aperture 220. The elongation allows the aperture 220 to have an increased flow area without the need to have an increased width. In this way, the overall width of the body 211 can be controlled to better fit onto the existing width of the shunt tube (200) or other tubular. Increasing the flow area on a conventional cylindrical-shaped insert and housing used in the prior art would require an increase in the overall diameter of the nozzle, which may actually surpass the width available on the tubular.

For thoroughness, some exemplary dimensions are provided for the nozzle 210 for use on a standard-sized shunt tube. For reference, the port 206 as shown in FIG. 4B may define an expanse E of about 0.344-in. As shown in FIGS. 5A-5D, the nozzle's longitudinal body 211 can have a length $L_1$ of about 2.00-in., a width $W_1$ of about 0.400-in., and a height H of about 0.200-in. The nozzle's longitudinal aperture 220 can have a length $L_2$ greater than about 0.487-in. and a width $W_2$ of about 0.250-in. The bottom end of the aperture 220 can have a length $L_3$ of about 0.487-in. The length $L_4$ of the lead end 216 is more than the length $L_5$ of the tail end 218. Thus, the lead end's length $L_4$ can be about 1.5 times longer than the tail end's length $L_5$, and the length $L_4$ can encompass almost half the length $L_1$ of the body 211.

Figure 6:
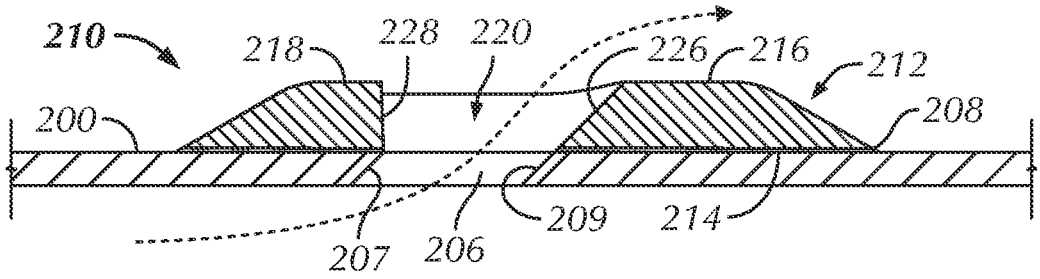
FIG. 6 is a cross-sectional view of the nozzle affixed to the surface of a shunt tube.

FIG. 6 is a cross-sectional view of the nozzle 210 affixed to the surface of the shunt tube 200. The nozzle 210 is preferably affixed by a brazing technique to the shunt tube 200. Brazing requires clean surfaces and tight tolerances for capillary action of the brazing material of the weldment 208 to achieve the best results. To braze the nozzle 210 on the tube 200, the nozzle 210 is cleaned and polished so the surface is wettable for brazeability. The material—typically 316 stainless steel—around the port 206 is also cleaned. Brazing alloy and flux are then used to braze the nozzle 210 on the surface of the tube 200 to form the weldment 208.

The brazing alloy used can be any suitable alloy for the application at hand. For a shunt tube of a wellscreen apparatus, the brazing alloy can preferably be composed of a silver-based braze, such as Braze 505 suited for 300-series stainless steels. Braze 505 has a composition of Ag (50%), Cu (20%), Zn (28%), and Ni (2%), although other possible alloys could be used. As is known, the flux covers the area to be brazed to keep oxygen from oxidizing the materials in the brazing process, which weakens the bond. Therefore, the flux is preferably suited for high-temperature and for use with the desired materials.

A torch brazing technique can be employed, although other techniques, such as furnace brazing, known in the art can be used. As is typical, the brazing temperature is preferably as low as possible, which will reduce the chance of damaging the components. In this way, the process of brazing the nozzle 210 to the surface of the tube 200 can be performed at a low temperature, which can minimize the risk of damage to the nozzle's contour, dimensions, etc.

Figure 7B:
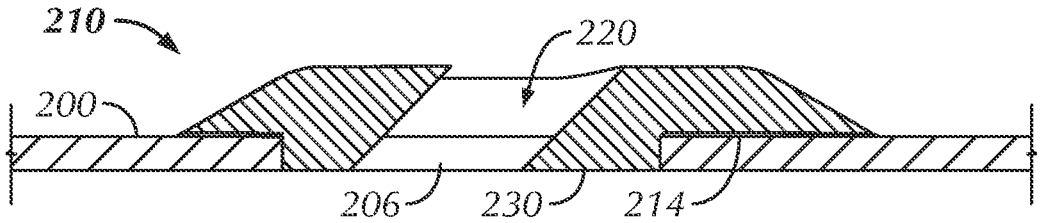
FIG. 7B is a cross-sectional view of an alternative nozzle having a lip.

To help orient the nozzle 210 and to protect the shunt tube's port 206, the nozzle 210 can have a lip 230, such as shown in FIG. 7B. The lip 230 is formed on the bottom surface 214 and extends around the aperture 220. When the nozzle 210 affixes to the tube 200, the lip 230 fits partially in the port 206. Therefore, when the nozzle 210 is used to flow slurry out of the port 206, the nozzle's lip 230 can reduce the potential for erosion around the inside edge of the tubular's port 206.

Rather than just a lip 230, the entire outer edge of the nozzle 210 can dispose in the aperture 220 and can affix thereto so that the entire bottom surface 214 of the nozzle 210 can be positioned in the flow tube 200 and not on the tube's exterior surface. In this arrangement, the top surface 212 of the nozzle 210 may or may not extend a distance beyond the exterior surface of the flow tube 200, although the nozzle 210 can have other features disclosed herein.

Figure 1:
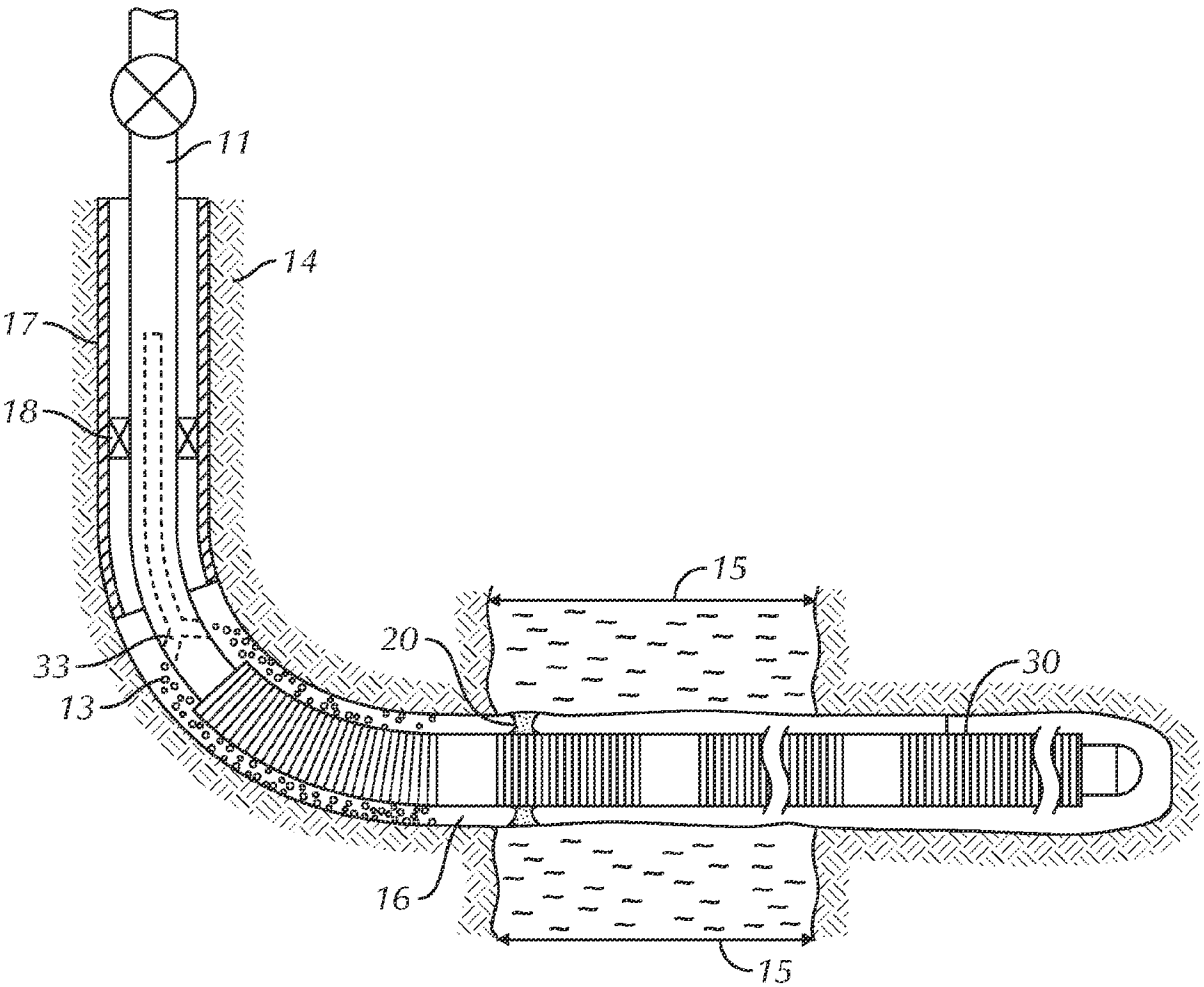
FIG. 1 (Prior Art)
FIG. 1 is a side view, partially in cross-section, of a horizontal wellbore with a wellscreen therein.
Figure 2B:
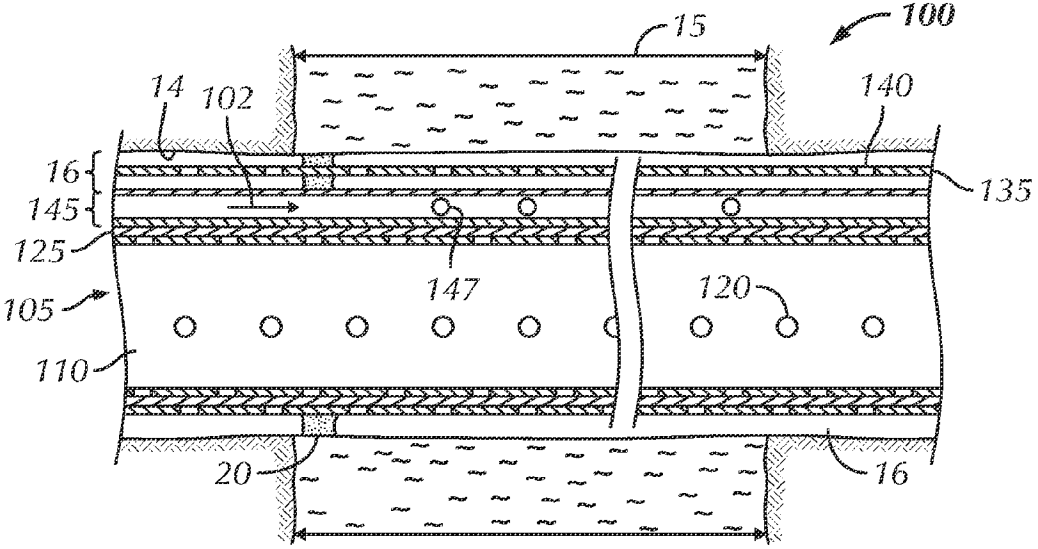
FIG. 2B (Prior Art)
FIG. 2B is a cross-sectional view of the gravel pack apparatus positioned within the wellbore adjacent a highly permeable area of a formation.
Figure 2C:
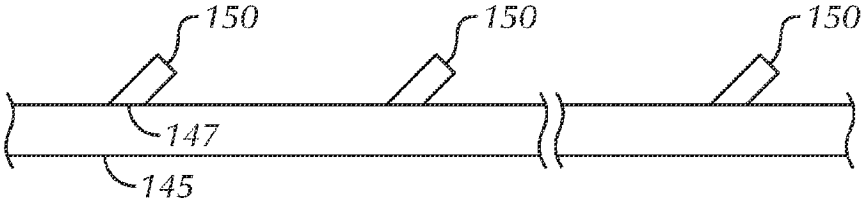
FIG. 2C (Prior Art)
FIG. 2C is a side view of a shunt showing placement of nozzles along the shunt.
Figure 2A:
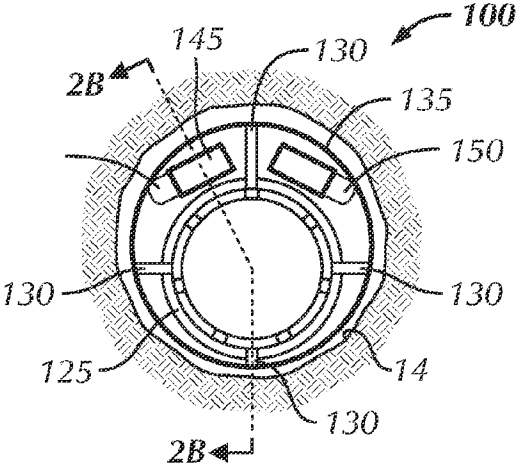
FIG. 2A (Prior Art)
FIG. 2A is a top end view of a gravel pack apparatus positioned within a wellbore.
Figure 3B:
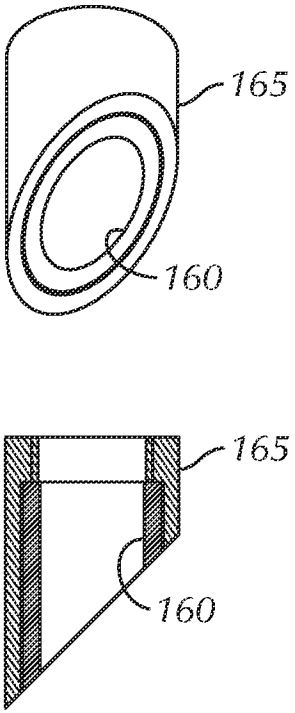
FIG. 3B (Prior Art)
FIG. 3B shows perspective and cross-sectional views of the prior art nozzle.
Figure 3A:
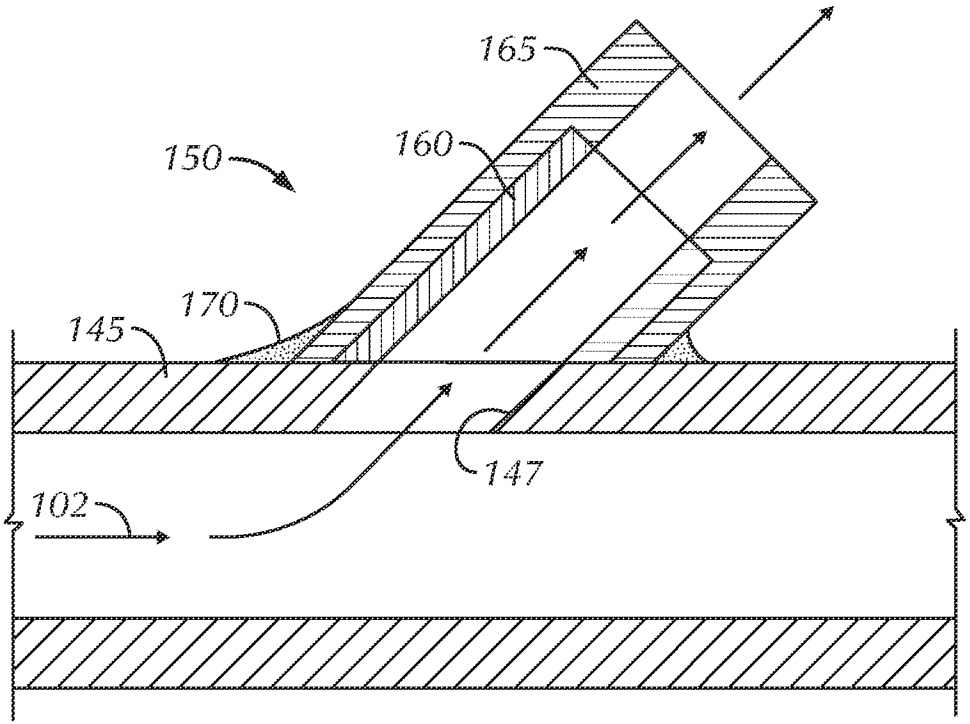
FIG. 3A (Prior Art)
FIG. 3A is a cross-sectional view of a prior art nozzle on a shunt tube.
Figures 1, 7C:
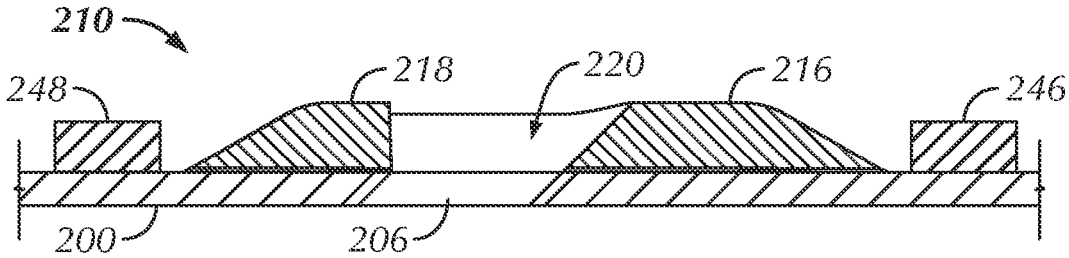

As seen in previous illustrations, the nozzle 210 disposes on the exterior surface of the shunt tube 200. To help physically protect the nozzle 210, deflectors 246 and 248 as shown in FIG. 7C-1 can be disposed adjacent the lead and tail ends 216 and 218. Composed of conventional materials, such as 316 stainless steel, the deflectors 246 and 248 can attach near the ends of the nozzle 210 to protect the nozzle 210 from impacts during run-in or pull-out. In another example shown in FIG. 7C-2, the deflectors 246 and 248 can have tapered or ramped ends (just like the nozzle's ends 216 and 218), which can minimize snagging or impact damage when the tube 200 and nozzle 210 are deployed in the well or inserted in a surrounding component (e.g., a wellscreen).

As noted previously, the nozzle 210 disposes on the exterior surface of the shunt tube 200 with the nozzle's bottom surface affixing to the exterior surface by brazing or the like. As such, the nozzle 210 is a separate component from the shunt tube 200. In an alternative shown in FIG. 7D-1, the nozzle 210 can have a body 211*a* that forms at least a portion of a flow tube (i.e., the nozzle 210 is an integral component of a shunt tube). In this instance, the body 211*a* defines a flow passage 211 communicating with the nozzle's aperture 220 and has first and second ends 213 and 215. The exterior features of the nozzle 210 around the aperture 220 are similar to those discussed previously, but they are integrally formed as part of the body 211*a*. Thus, the body 211*a* can be composed of an entirely erosion resistant material, or the body 211*a* can be composed of a conventional material with an erosion resistant coating (at least covering areas around the aperture 220).

Figures 2, 7C:
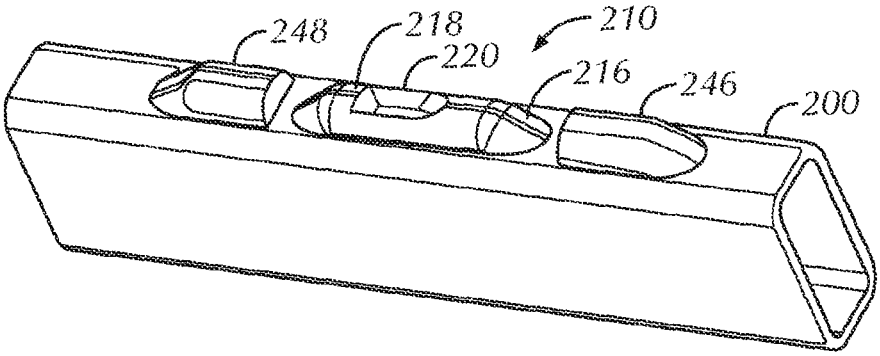
Figures 1, 7D:
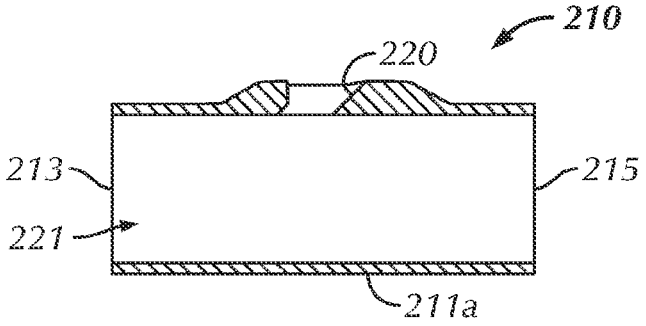
Figures 2, 7D:
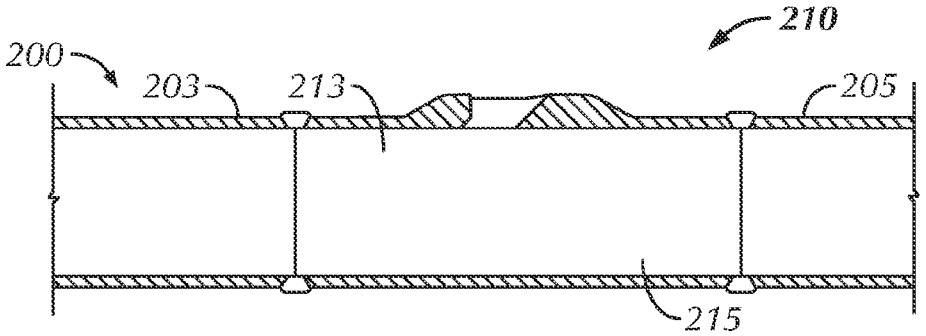
Figures 3, 7D:
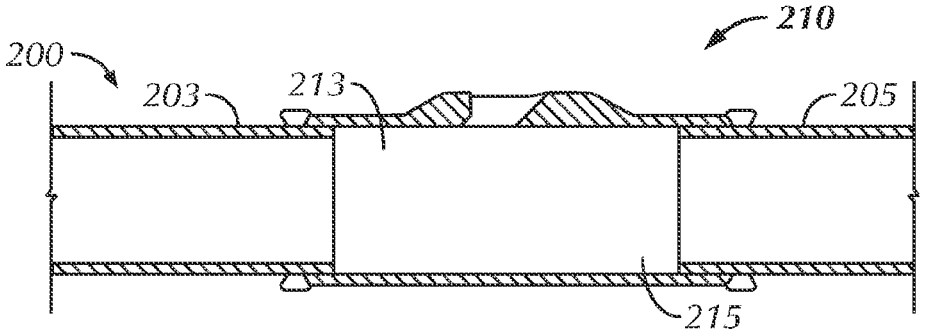

The length of the body 211*a* in FIG. 7D-1 can encompass the entire length of a shunt tube for an implementation. Alternatively, as shown in FIGS. 7D-2 and 7D-3, the body 211*a* of the nozzle 210 can make up just a part of a flow tube and can attach to sections 203 and 205 of a conventional shunt tube 200. These shunt tube sections 203 and 205 can attach respectively to the ends 213 and 215 of the nozzles body 211*a* in a number of ways, such as welding, fastening, threading, or other ways of affixing. Moreover, the ends 213 and 215 and sections 203 and 205 can affix end-to-end (as in FIG. 7D-2), or they can fit inside or outside one another (as in FIG. 7D-3).

Figures 4, 7D:
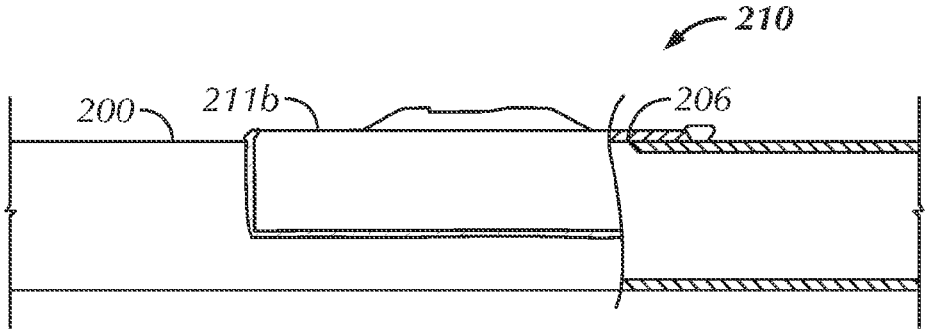

Finally, as shown in FIG. 7D-4, a body 211*b* of the nozzle 210 may only form a part of a flow tube and may affix to the interior or exterior surface of a conventional flow tube 200. As before, a shunt tube 200 can define a flow port 206, but the size of the port 206 can be larger than in previous arrangements because portions of the nozzle's body 211*b* can cover the extended size of the port 206. Although shown affixed to the exterior surface, the body 211*b* of the nozzle 210 can fit inside the shunt tube 200 and affix to an interior surface around the port 206. As will be appreciated, the disclosed nozzle 210 can have these and other configurations.

Figure 8A:
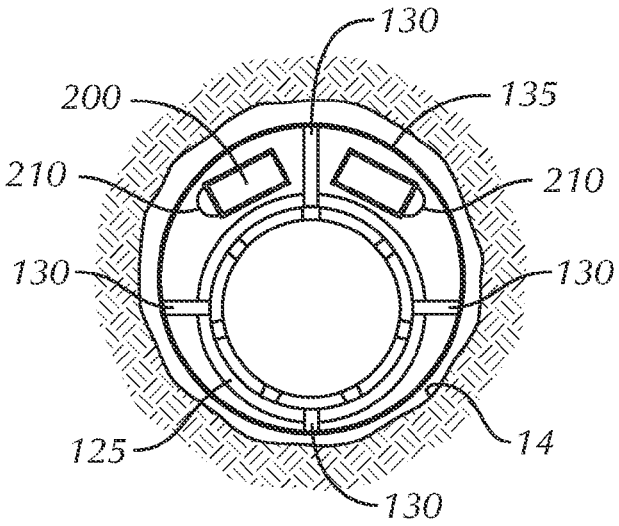
FIG. 8A is a top end view of a gravel pack apparatus having shunt tubes with nozzles according to the present disclosure.
Figure 8B:
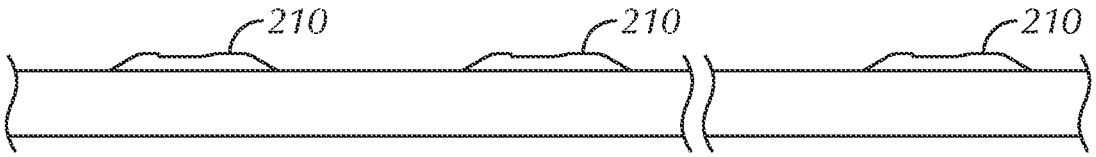
FIG. 8B is a side view of a shunt tube having nozzles according to the present disclosure.

As noted herein, the disclosed nozzles 210 can be used on shunt tubes 200 or the like for a gravel pack or frac pack assembly. Along these lines, FIG. 8A is an end view of a gravel pack apparatus 100 having shunt tubes 200 with nozzles 210 according to the present disclosure, and FIG. 8B is a side view of a shunt tube 200 having several nozzles 210 according to the present disclosure. Similar reference numerals are used from previous Figures for similar components and are not discussed here for brevity.

As can be seen, the nozzles 210 have a low profile against the shunt tubes 200. This reduces the amount of space required downhole, which can be a benefit in design and operation. The low profile of the nozzle 210 also reduces possible damage to the nozzle 210 during run-in or pull-out, especially if no shroud 135 is used.

Figure 9:
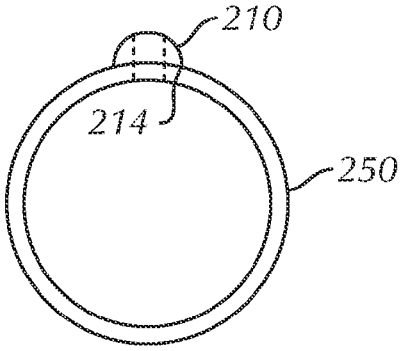
FIG. 9 is an end view of another tubular having a nozzle according to the present disclosure.

Although the nozzle 210 has been shown for use on a flat sidewall of a shunt tube 200, the disclosed nozzle 210 can be used on any type of tubular typically used downhole. For example, FIG. 9 is an end view of another tubular 250 having a nozzle 210 according to the present disclosure. The tubular 250 is cylindrical and can be a stand-alone tubular, a liner, a mandrel, a housing, or any part of any suitable downhole tool.

The bottom surface 214 of the nozzle's body 211 is countered to match the tubular's cylindrical surface. In this way, the nozzle 210 can have a rounded bottom surface 212 and can be used on any typical tubular used downhole, such as crossover tool, sliding sleeves, or any other downhole tubular where exiting flow could cause erosion. The flow through the tubular and exiting the nozzle 210 does not need to be a slurry either, because the nozzle 210 may be useful in any application having abrasive fluids or erosive flow.

Figure 10:
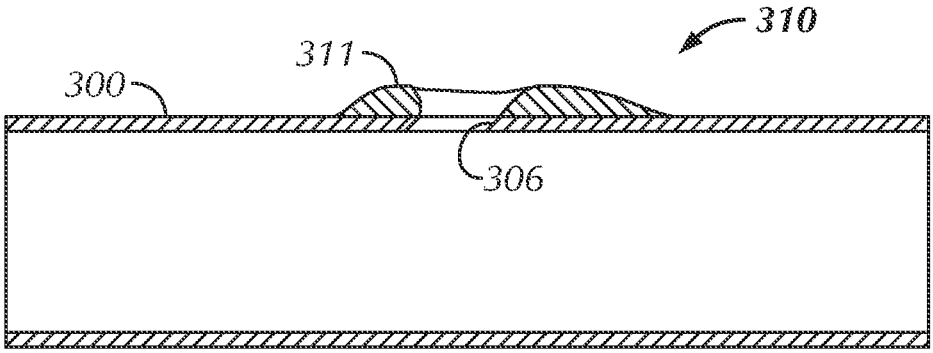
FIG. 10 is a cross-section of an alternative nozzle constructed from a hardened weld bead built up around a port of a shunt tube.

As an alternative to the separate body 211 of the nozzle 210 disclosed previously, another embodiment of a nozzle 310 as shown in FIG. 10 can be constructed from a hardened welded bead 311 built up around the port 306 of a tubular 300, such as a shunt tube. During manufacture, the port 306 is formed in the tubular 300, and operators then build the bead 311 of weldment material on the surface of the tubular 300 about this port 306, which makes the port 306 more erosion resistant.

In brief, the weld material of the bead 311 is built-up during the welding process around the port 306 in the tube 300. The weld is constructed dimensionally to provide desired erosion protection and accommodate different slot openings and can preferably have the features of the nozzles disclosed herein. The material used for the weldment bead 311 can include hard banding or a WearSox® thermal spray metallic coating. (WEARSOX is a registered trademark of Wear Sox, L.P. of Texas). A coating or plating composed of any other suitable material, such as "hard chrome," can be applied to the surfaces for erosion resistance.

Figures 2, 11A:
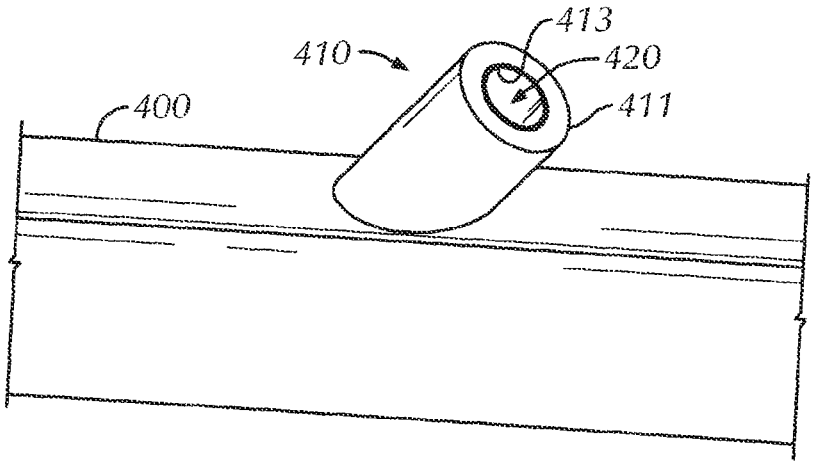

As an alternative to the tungsten carbide for the nozzle 210 disclosed previously, another embodiment of a nozzle 410 as shown in FIGS. 11A-1 and 11A-2 has a body 411 having a hard treated surface 413 on the inner surface of the body's aperture 420 for erosion resistance. Thus, rather than having the separate insert as in the prior art, the nozzle 410 of FIGS. 11A-1 and 11A-2 has its erosion resistant surface 413 integrally formed (i.e., coated, electroplated, or otherwise deposited) on the aperture 420 of the nozzle 410.

This hard treated surface 413 can be a plating of "hard chrome" or other suitable industrial material applied by electroplating or other procedure to the inside of the aperture 420. The hard treated surface 413 can be configured for a suitable hardness and thickness for the expected application and erosion resistances desired. In this way, the body 411 can be composed of a material other than tungsten carbide or the like. Yet, the nozzle 410 does not require a separate insert for erosion resistance as in the prior art.

Figures 1, 11A:
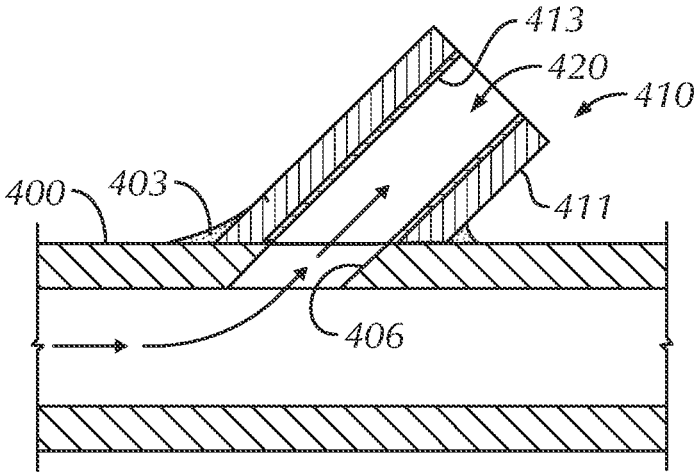
Figure 11B:
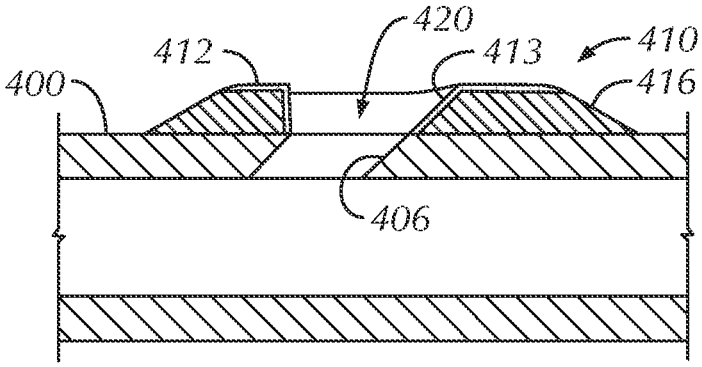
FIG. 11B is a cross-section of alternative nozzle having a hard treated surface applied to the inner aperture and other surfaces.

As shown in FIGS. 11A-1 and 11A-2, the body 411 of the nozzle 410 can be cylindrical and can attach to the surface 402 of the shunt tube 400 with a weld 403. As an alternative shown in FIG. 11B, the body 411 of the nozzle 410 can be shaped similar to pervious embodiments and can be brazed to the surface of the shunt tube 400. In this case, the hard treated surface 413 can be electroplated material applied to the aperture 420 as well as other surfaces of the nozzle 210, such as the top surface 212 and especially toward the lead end 416. Regardless of the body's shape, the surface 413 of FIGS. 11A-1 to 11B for the erosion resistant port 420 can have electroplated material applied using techniques known in the art.

In FIG. 12, another erosion resistant nozzle 430 disposed on a shunt tube 400 has a reverse arrangement than shown previously in FIGS. 11A-1 to 12, for example. Here, the nozzle 430 has an inner body 432 that defines a flow aperture 434, and an exterior hard treated surface 436 surrounds the inner body 432 and partially affixes to the tube 400. Although shown as cylindrical in shape, the body 432 of the nozzle 430 can have any shape comparable to the other embodiments disclosed herein.

The body 432 can be composed of a conventional material, such as a stainless steel or the like, can be cylindrical or other shape, and can affix to the shunt 400 in a known fashion. The exterior hard treated surface 436 can be a hard surface treatment, hard chrome plating, hard banding, or other comparable application integrally formed (i.e., coated, electroplated, or otherwise deposited) on the exterior of the nozzle 430. During use in erosive flow, the inner body 432 may erode sacrificially during pumping of slurry or the like through the flow aperture 434, but the hard exterior surface or coating 436 can limit or control the overall erosion that occurs.

Figure 12:
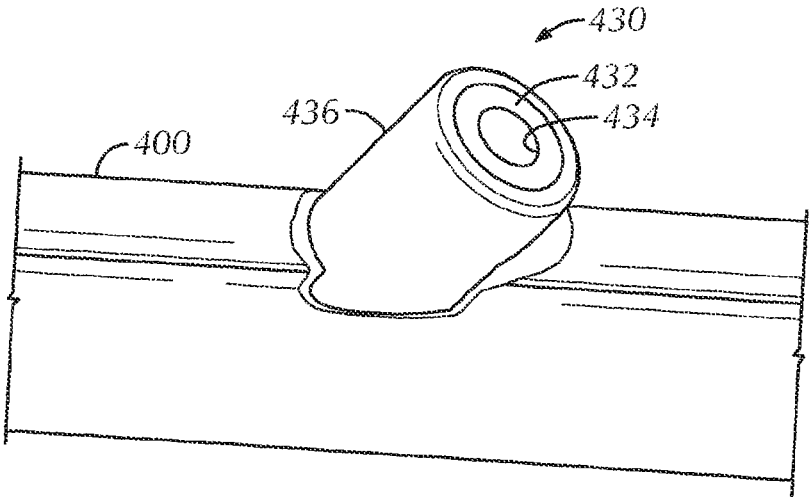
FIG. 12 is a perspective view of a nozzle having hard treated surface on inner sacrificial material.

Although not shown, another nozzle of the present disclosure can include the features of each of FIGS. 11A-1 through 12. In other words, the nozzle can be either cylindrical or shaped comparable to previous embodiments, and the outside of the flow nozzle as well as the inside of the aperture can have erosion resistant surfaces integrally formed (i.e., coated, electroplated, or otherwise deposited) thereon.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellbore apparatus, comprising:

a flow tube having an exterior surface and having a first flow passage along an axis; and a nozzle disposed on the flow tube and being at least partially erosion resistant, the nozzle being elongated along the axis and defining an angled aperture therethrough, the angled aperture angled at an acute angle relative to downstream flow along the axis of the first flow passage, the nozzle having a top surface of the nozzle exposed on the flow tube and having a top end of the angled aperture communicating with the first flow passage, a tail end of the exposed top surface disposed on one side of the angled aperture upstream of flow exiting the top end, and a lead end of the exposed top surface disposed on an opposing side of the angled aperture downstream of flow exiting the top end, the lead end encompassing more of a length of the nozzle along the axis than the tail end.

2. The apparatus of claim 1, wherein a bottom end of the angled aperture is elongated along the axis and communicating with the first flow passage, and wherein the top end of the angled aperture is elongated along the axis and communicating with the bottom end.

3. The apparatus of claim 1, wherein the nozzle comprises an erosion resistant material.

4. The apparatus of claim 1, wherein the nozzle comprises an erosion resistant surface.

5. The apparatus of claim 4, wherein the erosion resistant surface is at least disposed on an interior surface of the angled aperture.

6. The apparatus of claim 1, wherein the angled aperture has a lead endwall defining a first angle relative to the axis, and wherein the angled aperture has a tail endwall defining a second angle relative to the axis.

7. The apparatus of claim 6, wherein the first angle is more acute than the second angle.

8. The apparatus of claim 6, wherein the lead endwall has a width defining a curvature.

9. The apparatus of claim 6, wherein the angled aperture has sidewalls extending from the lead endwall to the tail endwall, the sidewalls flaring out from the bottom end to the top end of the aperture.

10. The apparatus of claim 1, wherein the top surface of the nozzle is disposed a distance beyond the exterior surface of the flow tube.

11. The apparatus of claim 10, wherein the distance the nozzle extends beyond the exterior surface of the flow tube is less than a width of the nozzle.

12. The apparatus of claim 10, wherein the top surface defines a curvature about a width of the nozzle.

13. The apparatus of claim 1, wherein the tail and lead ends each taper from the top end of the angled aperture toward extremities of the nozzle.

14. The apparatus of claim 1, wherein the top end of the angled aperture defines a greater flow area than the bottom end of the angled aperture.

15. The apparatus of claim 1, wherein the nozzle is an integral component of the flow tube.

16. The apparatus of claim 1, wherein the nozzle is a separate component from the flow tube.

17. The apparatus of claim 16, wherein the flow tube defines a flow port in an exterior surface, and wherein the nozzle has an edge disposed in the flow port.

18. The apparatus of claim 17, wherein the edge of the nozzle comprises a lip surrounding the bottom end of the aperture and at least partially disposed in the flow port.

19. The apparatus of claim 16, wherein the flow tube defines a flow port in an exterior surface, wherein at least a portion of a bottom surface of the nozzle is affixed to the exterior surface, and wherein the bottom end of the angled aperture communicates with the flow port.

20. The apparatus of claim 19, wherein the bottom end of the aperture defines an elongated contour matching the flow port.

21. The apparatus of claim 19, wherein the bottom surface is brazed to the exterior surface of the flow tube.

22. The apparatus of claim 16, wherein the nozzle comprises first and second ends and defines a second flow passage through the first and second ends; and wherein the flow tube comprises a first section connected to the first end and comprises a second section connected to the second end, the first flow passage of the flow tube communicating with the second flow passage of the nozzle.

23. The apparatus of claim 1, further comprising at least one deflector disposed on the flow tube along the axis adjacent the nozzle.

24. The wellbore apparatus of claim 1, further comprising a wellscreen having the flow tube disposed thereon.

25. The apparatus of claim 1, wherein at least a portion of the flow tube around the flow port has an erosion resistant material.

26. The apparatus of claim 25, wherein the flow tube comprises the erosion resistant material.

27. The apparatus of claim 1, wherein the nozzle comprises a coating for the erosion resistance applied at least to the angled aperture.

28. The apparatus of claim 1, wherein the nozzle comprises a heat treated surface for the erosion resistance of the angled aperture.

29. The apparatus of claim 1, wherein the nozzle comprises a weldment formed around the flow port.

30. A nozzle for use on a flow port in an exterior surface of a downhole flow tube, the nozzle comprising:

a body being elongated along an axis of the flow tube, the body being at least partially erosion resistant and defining an angled aperture therethrough, the angled aperture angled at an acute angle relative to downstream flow along the axis of flow tube;

a bottom surface of the body affixing to the exterior surface along the axis and defining a bottom end of the angled aperture, the bottom end communicating with the flow port of the flow tube;

a top surface of the body defining a top end of the angled aperture;

a tail end of the body disposed on one side of the angled aperture upstream of flow exiting the angled aperture; and a lead end of the body disposed on an opposing side of the angled aperture downstream of flow exiting the angled aperture, the lead end encompassing more of a length of the body along the axis than the tail end.

31. The nozzle of claim 30, wherein the body has an erosion resistant surface integrally formed thereon.

32. The nozzle of claim 31, wherein an inside surface of the angled aperture has the erosion resistant surface integrally formed thereon.

33. The nozzle of claim 31, wherein an outside surface of the body has the erosion resistant surface integrally formed thereon.

* * * * *